US005975088A

United States Patent [19]

Stehman

[11] Patent Number: 5,975,088

[45] Date of Patent: Nov. 2, 1999

[54] NAIL POLISH DISPENSER AND RECEPTACLE

[76] Inventor: Sherry M. Stehman, 2917 Tanglewood La., Norristown, Pa. 19403

[21] Appl. No.: 09/053,861

[22] Filed: Mar. 27, 1998

[51] Int. Cl.[6] ..... A45D 34/04

[52] U.S. Cl. ..... 132/74.5; 401/119

[58] Field of Search ..... 132/73, 74.5, 317; 401/119, 120, 126, 129, 185

[56] References Cited

U.S. PATENT DOCUMENTS

| | | | |
|---|---|---|---|
| 748,040 | 12/1903 | Barns | 401/119 |
| 1,313,566 | 8/1919 | Trowbridge | 401/19 |
| 1,980,878 | 11/1934 | Robinson | 401/126 |
| 2,009,899 | 7/1935 | Nagl et al. | 401/129 |
| 2,104,651 | 1/1938 | Hoffman, Jr. | 132/73 |
| 2,248,011 | 7/1941 | Neuschaefer | 401/129 |
| 2,516,542 | 7/1950 | Blackman | 132/74.5 |
| 2,791,789 | 5/1957 | Smith et al. | 401/119 |
| 2,909,798 | 10/1959 | Marion | 15/136 |
| 2,926,374 | 3/1960 | Adler | 401/119 |
| 3,178,755 | 4/1965 | Kormann | 15/518 |
| 3,369,854 | 2/1968 | Ferris | 401/119 |
| 3,411,853 | 11/1968 | Hoff | 401/134 |
| 3,786,820 | 1/1974 | Kopfer | 132/74.5 |
| 3,995,647 | 12/1976 | Kopfer | 132/74.5 |
| 4,625,741 | 12/1986 | Gardiner | 132/79 |
| 4,640,637 | 2/1987 | Winthrop | 401/101 |
| 4,710,048 | 12/1987 | Vartoughian | 401/269 |
| 4,902,152 | 2/1990 | Seidler | 401/117 |
| 5,071,277 | 12/1991 | Braun | 401/126 |

*Primary Examiner*—Todd E. Manahan
*Attorney, Agent, or Firm*—Joseph W. Molasky & Associates

[57] ABSTRACT

A nail polish dispenser including a hollow tube applicator and a receptacle with a recessed central bottom region. The applicator is formed to include bristles at one end and a pressure bulb attached to the opposing end. An aperture is formed in the tube in proximity to the end containing the bristles. The hollow tube is filled with polish so that as the bulb is squeezed, the polish will exit the aperture and flow onto the bristles. The utilization of such an applicator design allows for a large number of nails to be polished without refilling the applicator. The recessed bottom region of the receptacle allows for the collection of polish as the liquid is depleted, as well as providing a holding area for the application means when not is use.

13 Claims, 1 Drawing Sheet

FIG.1
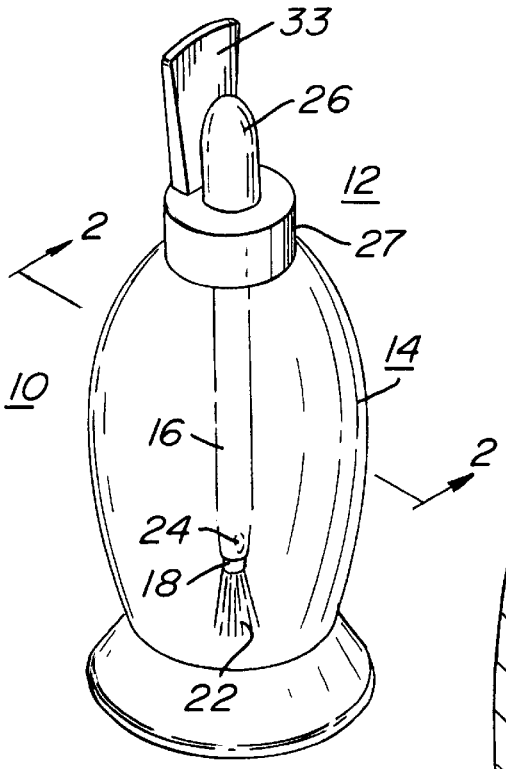
FIG.2
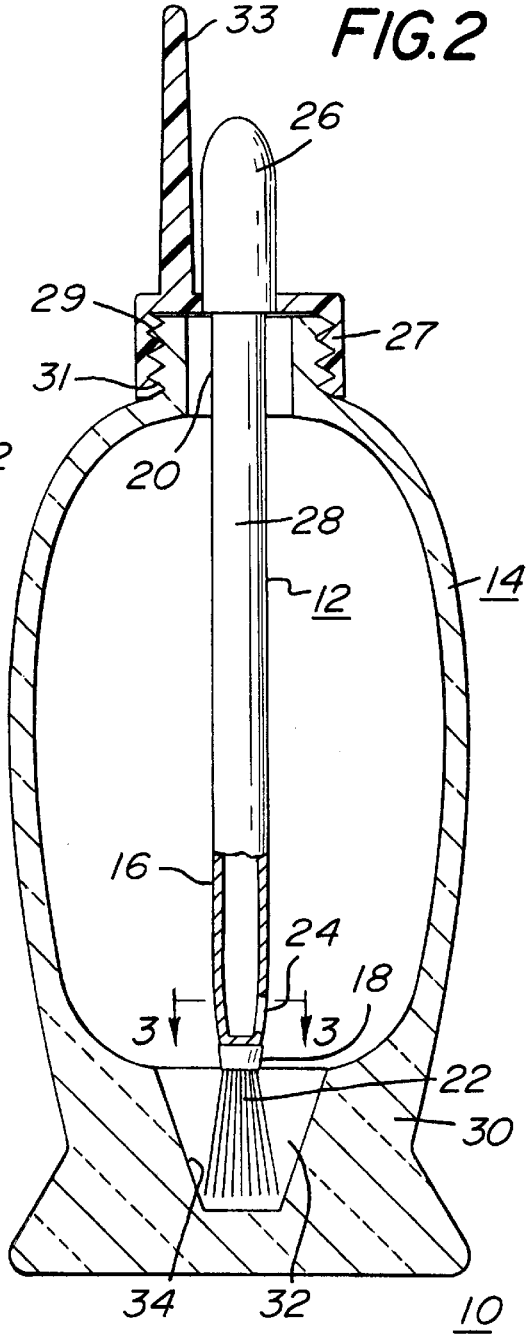
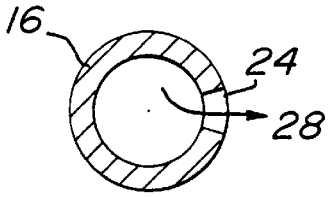
FIG. 3

NAIL POLISH DISPENSER AND RECEPTACLE

BACKGROUND OF THE INVENTION

1. Field of the Invention

The present invention relates to a nail polish dispenser and, more particularly, to a nail polish dispenser with an improved applicator design.

2. Background of the Invention

Conventional nail polish dispensers are well-known and consist of a simple brush applicator including a screw top for engaging with a nail polish receptacle (i.e. bottle). Many variations exist, including disposable arrangements that store a one-time application of polish in an inner recess of the applicator, the applicator then being thrown away after use. U.S. Pat. No. 4,625,741 is exemplary of this disposable type of polisher.

SUMMARY OF THE INVENTION

The present invention relates to a nail polish dispenser and, more particularly, to a nail polish dispenser including an improved applicator design. The applicator comprises a hollow tube with a necked-own first end and a suction bulb removably attached to the second, opposing end. Application means, such as a plurality of bristles, is attached in a fixed manner to the necked-down end. A flow aperture is formed in the side of the tube, in proximity to the necked-down first end. The tube is filled with nail polish by squeezing the suction bulb and pulling the liquid up into the hollow tube. The bulb is then replaced. As the bulb is squeezed, the pressure in the tube will force the liquid through the aperture and onto the bristles. The ability to store the liquid in the tube allows for a large number of nails to be polished without refilling the tube.

An additional feature of the present invention relates to the receptacle design, which is configured to include a central well region in the bottom surface. This central well allows for the polish to naturally flow into this area as the polish is used and also keeps the application means from being damaged during storage. Unlike prior art disposable applicators, the nail polish dispenser of the present invention may be re-filled with polish and used time and again.

Other and further features of the present invention will become apparent during the course of the following discussion and by reference to the accompanying drawings.

BRIEF DESCRIPTION OF THE DRAWINGS

Referring now to the drawings,

FIG. 1 illustrates an exemplary nail polish dispenser formed in accordance with the present invention;

FIG. 2 is a cut-away side view of the dispenser of FIG. 1, taken along line 2—2; and FIG. 3 is a sectional view of the nail polish applicator, taken along line 3—3 of FIG. 2.

DETAILED DESCRIPTION OF THE PREFERRED EMBODIMENT

An exemplary nail polish dispenser 10 of the present invention is illustrated in FIGS. 1 and 2. Dispenser 10 includes an applicator 12 and receptacle 14. Applicator 12 comprises a hollow tube 16 having a first, necked-down end 18 and a second, opposing end 20. An application means 22, in this example a plurality of bristles, is attached to first end 18. Many arrangements for attaching application means 22 may be used and all are considered to fall within the spirit and scope of the present invention. For example, the application means could be glued within the inner diameter of tube 16, or alternatively, inserted in a straight-walled tube that is subsequently heat treated to form a necked-down structure such that the pressure is sufficient to hold the application means in place. Alternatively, a separate member for holding the application means may be attached to end 18 of tube 16. Various other possible arrangements could also be used.

Referring back to FIG. 1, applicator 12 further includes an aperture 24 formed in hollow tube 16 in the proximity of first end 18. FIG. 3 is a sectional view of tube 16, illustrating in particular the location of aperture 24. A suction bulb 26 is removably attached, as shown, to second end 20 of tube 16. Bulb 26 is further attached to a cap 27 that is removably attached to receptacle 14 In the illustrated embodiment, cap 27 includes inner threads 29 that mate with outer threads 31 on receptacle 14 to provide attachment. An external handling member 33 may be attached to cap 29 to provide a rigid holding surface for applicator 16 as it is used. The use of such a handling member is considered to be discretionary.

To use the applicator of the present invention, a desired quantity of nail polish liquid 28 is first poured into tube 16 (by removing bulb 26 and filling from the second end 20). As bulb 26 is squeezed, the pressure within tube 16 wll force liquid 28 downward and out through aperture 24, as illustrated by the arrow on FIG. 3. Liquid 28 will thereafter propagate down onto application means 22, where it can be used to polish nails. The degree and duration of the pressure application to bulb 26, as well as the size of aperture 24, will dictate the amount of liquid 28 that exits aperture 24 during a given period of time. These variables are considered to be discretionary. The size of aperture 24 should obviously not be so small as to constrict the flow of polish, nor so large as to allow the polish to flow out without the application of any pressure to bulb 26.

The utilization of a conventional sized tube (such as a medicine dropper) has been found to hold a volume of polish sufficient to polish a number of nails. Thus, compared with prior art applicators where the applicator is dipped into the liquid before polishing each separate nail, the applicator of the present invention exhibits a significant improvement in efficiency.

Evident in the cut-away view of FIG. 2 is the de sign of polish receptacle 14. Receptacle 14 includes a bottom section 30 with a centrally disposed recessed area 32. Recessed area 32 functions as a receptor area for application means 22 of applicator 14. Additionally, the inclusion of a centrally recessed area allows for polish 28 to accumulate in this region as the amount of liquid in receptacle 14 is depleted. There are many different configurations suitable for forming recessed area 32. The arrangement of FIG. 2 illustrates inwardly sloping sidewalls 34 that gradually taper toward recessed area 32. Alternatively, receptacle 14 may comprise an essentially flat, annular-shaped outer bottom surface with recessed area formed as a circular depression in the center of the annular region.

What is claimed is:

1. Nail polish dispenser comprising:

a nail polish applicator including;

a hollow tube having a first end and a second, opposing end, and an aperture formed in said tube on its sidewall in proximity to said first end;

application means attached to said first end; and a pressure bulb removably attached to said second end such that when said hollow tube is filled with polish and the pressure bulb is squeezed, the polish will flow through said aperture and onto said application means;

a cap attached to said pressure bulb; and a nail polish receptacle removably attached to said cap and including an opening for engaging said nail polish applicator, sidewalls, and a bottom surface, said bottom surface including a centrally disposed recessed area.

2. A nail polish dispenser as defined in claim 1 wherein the application means comprises a plurality of bristles.

3. A nail polish dispenser as defined in claim 1 wherein the first end of the applicator is tapered to form a necked-down end portion.

4. A nail polish dispenser as defined in claim 1 wherein the application means is glued to the first end of the applicator.

5. A nail polish dispenser as defined in claim 1 wherein the first end of the applicator is tapered to form a necked-down end portion and the application means is force-fit into the necked-down end portion.

6. A nail polish dispenser as defined in claim 1 wherein the receptacle sidewalls taper inwardly toward the bottom surface.

7. A nail polish dispenser as defined in claim 1 wherein said centrally disposed recessed area is a well having inwardly sloping sidewalls.

8. A nail polish dispenser as defined in claim 1 wherein the applicator cap further comprises an external handling member to provide support for said applicator as it is being used.

9. A nail polish applicator as defined in claim 8 wherein the application means comprises a plurality of bristles.

10. A nail polish dispenser as defined in claim 9 wherein the application means is glued to the first end of the applicator.

11. A nail polish dispenser as defined in claim 8 wherein the first end of the applicator is tapered to form a necked-down end portion.

12. A nail polish dispenser as defined in claim 8 wherein the first end of the applicator is tapered to form a necked-down end portion and the application means is force-fit into the necked-down end portion.

13. A nail polish applicator including a hollow tube having a first end add a second, opposing end, an aperture formed in said tube on its sidewall in proximity to said first end;

application means attached to said first end; and a pressure bulb removably attached to said second end such that when said hollow tube is filled with polish and the pressure bulb is squeezed, the polish will flow through said aperture and onto said application means.

* * * * *